US006454357B1

(12) United States Patent
Foulger

(10) Patent No.: US 6,454,357 B1
(45) Date of Patent: Sep. 24, 2002

(54) COLLAPSIBLE FOOTREST

(76) Inventor: Erma Jean M. Foulger, 365 Clark St., Salt Lake City, UT (US) 84107

( * ) Notice: Subject to any disclaimer, the term of this patent is extended or adjusted under 35 U.S.C. 154(b) by 0 days.

(21) Appl. No.: 09/775,440

(22) Filed: Feb. 2, 2001

(51) Int. Cl.[7] ..... A47C 16/00
(52) U.S. Cl. ..... 297/423.41; 108/131
(58) Field of Search ..... 297/423.41, 423.39; 108/129, 130, 131, 132, 36

(56) References Cited

U.S. PATENT DOCUMENTS

| | | | | | |
|---|---|---|---|---|---|
| 2,177,174 | A | | 10/1939 | Eccles | |
| D173,902 | S | | 1/1955 | Hamilton | |
| 3,072,451 | A | * | 1/1963 | Greenberg et al. | 108/132 |
| 3,271,075 | A | | 9/1966 | Good | |
| 3,650,562 | A | | 3/1972 | Adler | |
| 4,228,745 | A | | 10/1980 | Gale | |
| 4,559,878 | A | * | 12/1985 | Colby | 108/129 X |
| 5,244,255 | A | | 9/1993 | Hill | |
| 5,279,233 | A | * | 1/1994 | Cox | 108/132 X |
| 5,941,181 | A | * | 8/1999 | Hornberger et al. | 108/131 X |
| 5,943,965 | A | * | 8/1999 | Riach et al. | 108/131 X |
| 6,058,853 | A | * | 5/2000 | Pinch | 108/129 |

FOREIGN PATENT DOCUMENTS

| | | | | |
|---|---|---|---|---|
| DE | 2539688 | * | 3/1976 | 108/129 |
| GB | 597623 | * | 1/1948 | 297/423.31 |

* cited by examiner

*Primary Examiner*—Peter M. Cuomo
*Assistant Examiner*—Stephen Vu

(57) ABSTRACT

A collapsible footrest is provided for resting a pair of feet. The collapsible footrest includes a table portion including a plate having a top surface, a bottom surface, a front edge, a back edge, a first side edge and a second side edge. A support assembly supports the table portion above a ground surface. The support assembly comprises a bracket assembly securely coupled to the bottom surface of the plate. Each of the leg members has a first end rotatably coupled to the bracket assembly. The leg members may be selectively rotated between a position abutting the plate and a position extending away from the plate.

5 Claims, 5 Drawing Sheets

COLLAPSIBLE FOOTREST

BACKGROUND OF THE INVENTION

1. Field of the Invention

The present invention relates to footrest devices and more particularly pertains to a new collapsible footrest for resting feet upon when a chair or other sitting area is relatively to high for the used.

2. Description of the Prior Art

The use of footrest devices is known in the prior art. More specifically, footrest devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,228,745; 3,271,075; 3,650,562; 2,177,174; 5,244,255; and U.S. Des. Pat. No. 173,902.

While these devices fulfill their respective, particular objectives and requirements, the aforementioned patents do not disclose a new collapsible footrest. The inventive device includes a table portion including a plate having a top surface, a bottom surface, a front edge, a back edge, a first side edge and a second side edge. A support assembly supports the table portion above a ground surface. The support assembly comprises a bracket assembly securely coupled to the bottom surface of the plate. Each of a plurality of leg members has a first end rotatably coupled to the bracket assembly. The leg members may be selectively rotated between a position abutting the plate and a position extending away from the plate.

In these respects, the collapsible footrest according to the present invention substantially departs from the conventional concepts and designs of the prior art, and in so doing provides an apparatus primarily developed for the purpose of resting feet upon when a chair or other sitting area is relatively to high for the used.

SUMMARY OF THE INVENTION

In view of the foregoing disadvantages inherent in the known types of footrest devices now present in the prior art, the present invention provides a new collapsible footrest construction wherein the same can be utilized for resting feet upon when a chair or other sitting area is relatively to high for the used.

The general purpose of the present invention, which will be described subsequently in greater detail, is to provide a new collapsible footrest apparatus and method which has many of the advantages of the footrest devices mentioned heretofore and many novel features that result in a new collapsible footrest which is not anticipated, rendered obvious, suggested, or even implied by any of the prior art footrest devices, either alone or in any combination thereof.

To attain this, the present invention generally comprises a table portion including a plate having a top surface, a bottom surface, a front edge, a back edge, a first side edge and a second side edge. A support assembly supports the table portion above a ground surface. The support assembly comprises a bracket assembly securely coupled to the bottom surface of the plate. Each of a plurality of leg members has a first end rotatably coupled to the bracket assembly. The leg members may be selectively rotated between a position abutting the plate and a position extending away from the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible footrest apparatus and method which has many of the advantages of the footrest devices mentioned heretofore and many novel features that result in a new collapsible footrest which is not anticipated, rendered obvious, suggested, or even implied by any of the prior art footrest devices, either alone or in any combination thereof.

It is another object of the present invention to provide a new collapsible footrest which may be easily and efficiently manufactured and marketed.

It is a further object of the present invention to provide a new collapsible footrest which is of a durable and reliable construction.

An even further object of the present invention is to provide a new collapsible footrest which is susceptible of a low cost of manufacture with regard to both materials and labor, and which accordingly is then susceptible of low prices of sale to the consuming public, thereby making such collapsible footrest economically available to the buying public.

Still yet another object of the present invention is to provide a new collapsible footrest which provides in the apparatuses and methods of the prior art some of the advantages thereof, while simultaneously overcoming some of the disadvantages normally associated therewith.

Still another object of the present invention is to provide a new collapsible footrest for resting feet upon when a chair or other sitting area is relatively to high for the used.

Yet another object of the present invention is to provide a new collapsible footrest which includes a table portion including a plate having a top surface, a bottom surface, a front edge, a back edge, a first side edge and a second side edge. A support assembly supports the table portion above a ground surface. The support assembly comprises a bracket assembly securely coupled to the bottom surface of the plate. Each of a plurality of leg members has a first end rotatably coupled to the bracket assembly. The leg members may be selectively rotated between a position abutting the plate and a position extending away from the plate.

Still yet another object of the present invention is to provide a new collapsible footrest that is smaller than a typical footrest, having a maximum height less than 8 inches and which is collapsible for easy carrying to be used at movie theaters, stadiums, and the like.

Even still another object of the present invention is to provide a new collapsible footrest that folds into a device approximately 5 inches wide by 5 inches long by 2 inches high.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
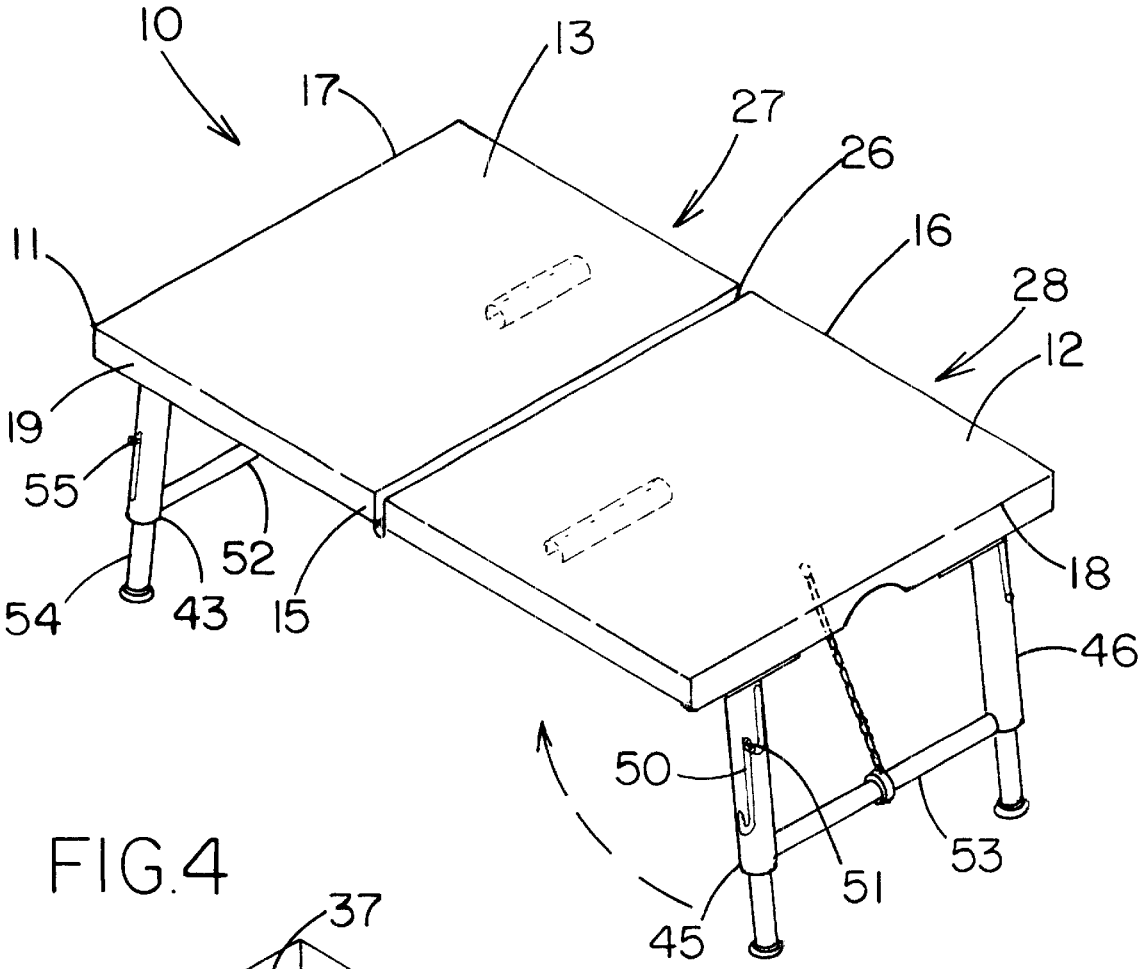
FIG. 1 is a schematic perspective view of a new collapsible footrest according to the present invention.
Figure 4:
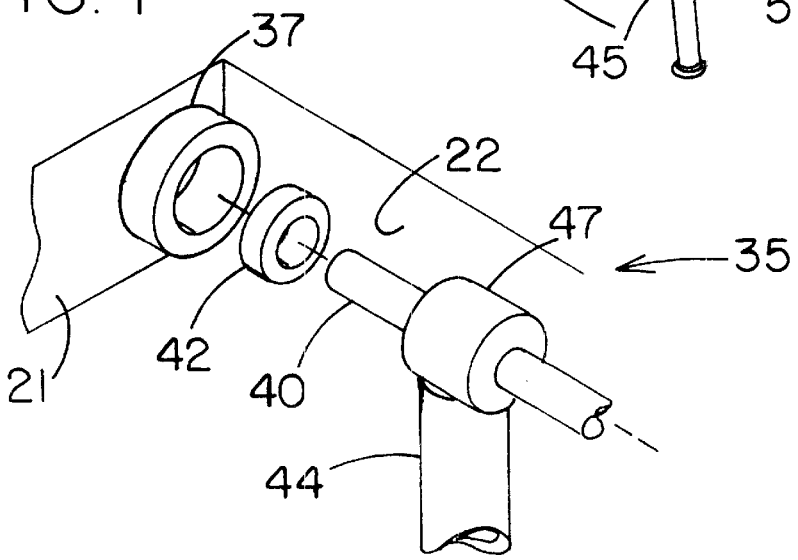
FIG. 4 is a schematic perspective view of the bracket assembly of the first embodiment of the present invention.
Figure 3:
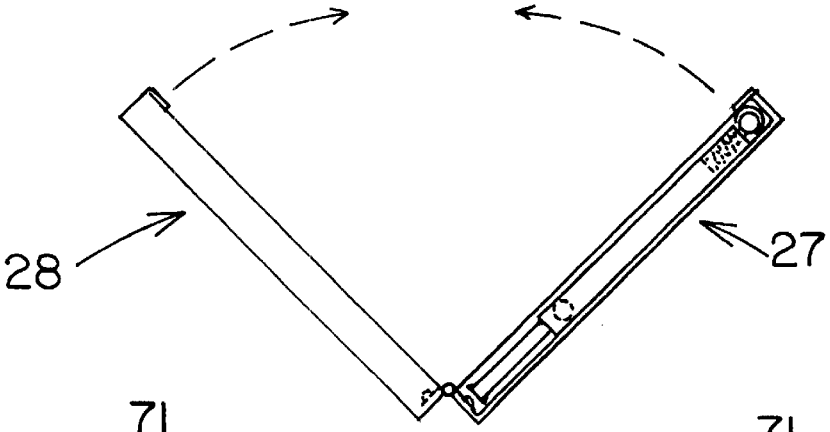
FIG. 3 is a schematic side view of the present invention.
Figure 2:
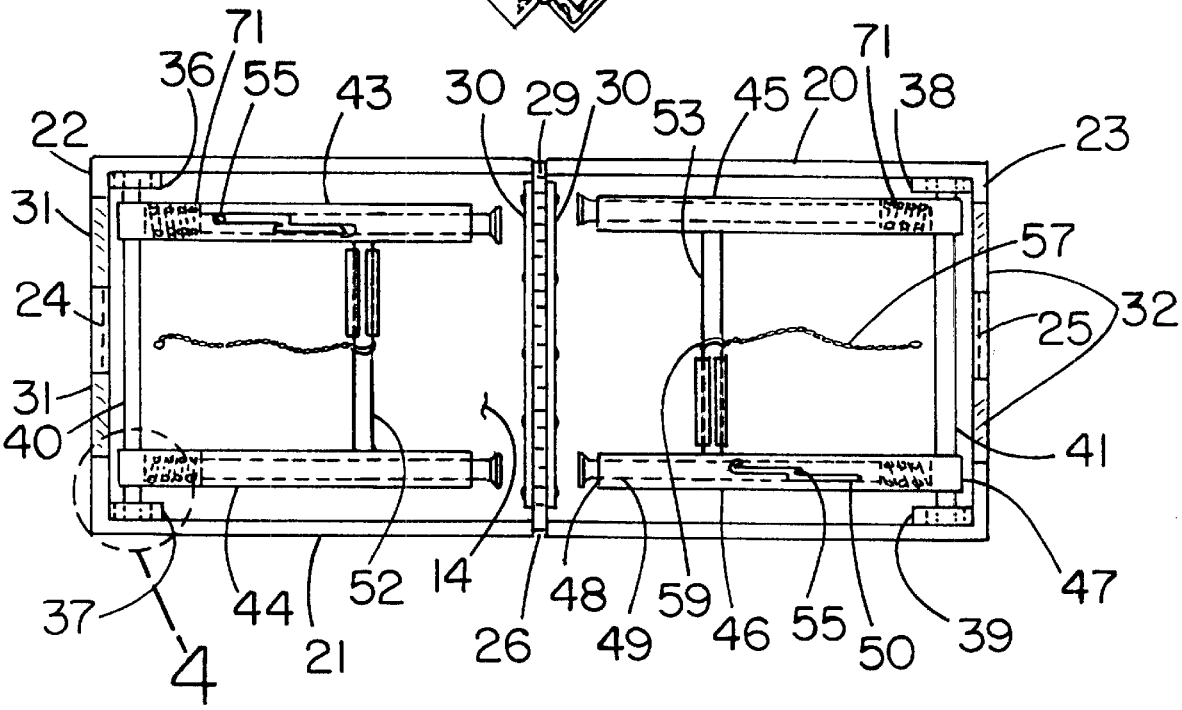
FIG. 2 is a schematic bottom view of the present invention.
Figure 5:
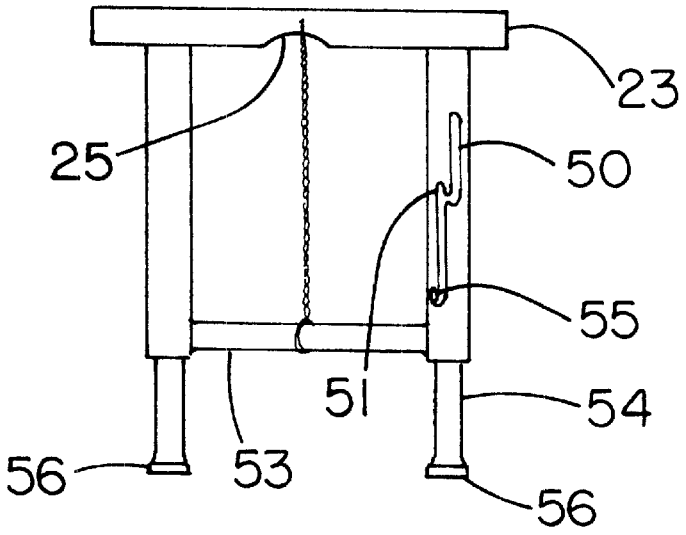
FIG. 5 is a schematic end view of the present invention.
Figure 6:
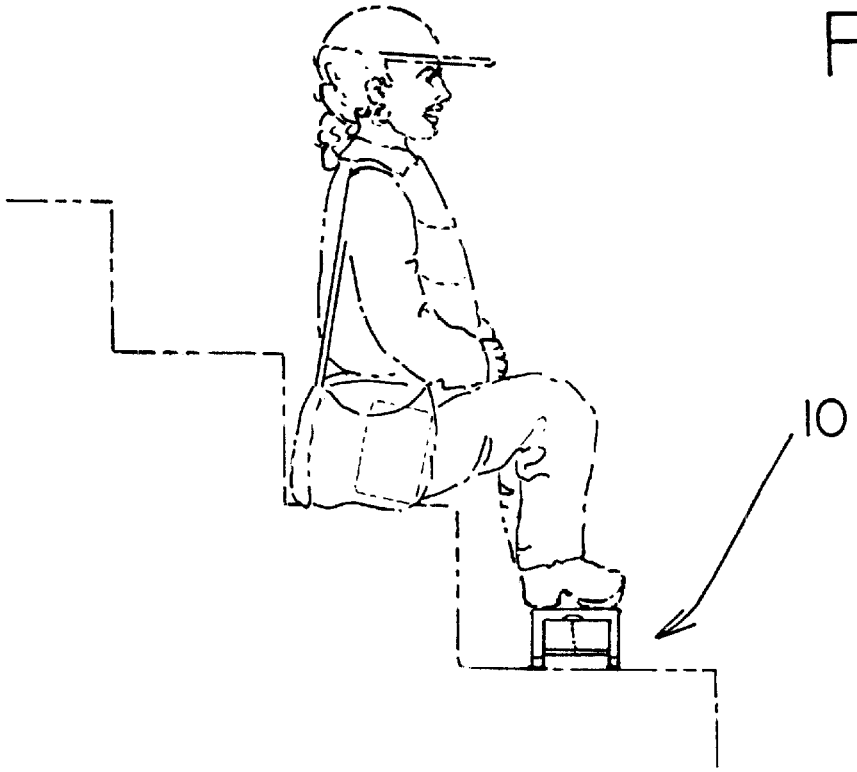
FIG. 6 is a schematic end in-use view of the present invention.

With reference now to the drawings, and in particular to FIGS. 1 through 6 thereof, a new collapsible footrest embodying the principles and concepts of the present invention and generally designated by the reference numeral 10 will be described.

As best illustrated in FIGS. 1 through 6, the first embodiment of the collapsible footrest 10 generally comprises a table portion 11 including a plate 12 having a top surface 13, a bottom surface 14, a front edge 15, a back edge 16, a first side edge 17 and a second side edge 18. The plate 12 has a length between the side edges generally between 8 inches and 12 inches and a width between the front and back edges generally between 4 inches and 6 inches.

A peripheral lip 19 is integrally coupled to and extends downward from the plate 12 such that a front portion 20, a back portion 21, a first side portion 22 and second side portion 23 of the peripheral lip 19 is defined with respect to the front 15, back 16 and side edges 17, 18 of the plate 12. The peripheral lip 19 has a pair of arcuate grooves 24, 25 therein. A first 24 of the arcuate grooves is positioned in the first side portion 22 and located between the front 15, 16 and back edges. A second 25 of the arcuate grooves is positioned in the second side portion 23 and located between the front 15 and back 16 edges. The plate 12 has a break 26 therein extending between the front 15 and back 16 edges and through the lip 19 such that a first 27 and second 28 portion of the table portion 11 is defined. The peripheral lip 19 preferably has a height less than 1 inch.

A hinge 29 hingedly couples the first portion 27 to the second portion 28. The hinge 29 extends along the break 26 and is securely coupled to a flange 30 extending downwardly from either side of the break 26 such that the first 27 and second 28 portions may selectively be positioned between an open position and a closed position.

A pair of metal portions 31 is securely coupled to an edge of the lip and positioned on either side of the first groove 24. A pair of magnets 32 is securely coupled to an edge of the lip and positioned on either side of the second groove 25 such that the magnets 32 may releasably engage the metal portions 31 when the first 27 and second 28 portions are in the closed position.

A support assembly supports 35 the table portion 11 above a ground surface. The support assembly 35 comprises a bracket assembly securely coupled to the bottom surface of the plate 12 and includes a plurality of annular members each securely attached to an inner surface of the lip 19. A first of the annular members 36 is positioned on the front portion 20 and generally adjacent to the first side portion 22. A second of the annular members 37 is positioned on the back portion 21 and is generally coaxial with the first annular member 36. A third of the annular members 38 is positioned on the front portion 20 and generally adjacent to the second side portion 23. A fourth of the annular members 39 is positioned on the back portion 21 and generally coaxial with the third annular member 38.

A pair of shafts 40, 41 extend across oppositely disposed annular members such that a first of the shafts 40 extends between and is rotatably coupled to the first 36 and second 37 annular members and a second of the shafts 41 extends between and is rotatably coupled to the third 38 and fourth 39 annular members.

Ideally, each of a plurality of plastic bushings 42 is positioned in one of the annular members 36–39 for receiving an end of the first 40 and second 41 shafts. The bushings 42 allow the shafts to rotate but with a frictional resistance.

Each of a plurality of leg members 43–46 has a first end 47 and a second end 48. The first shaft 40 extends through a first 43 and second 44 of the leg members and is positioned generally adjacent to the first ends 47 of the first and second leg members. The second shaft 41 extending through a third 45 and fourth 46 of the leg members and is positioned generally adjacent to the first ends 47 of the second and third leg members. Each of the leg members preferably has a length between 3 inches and 4 inches. Each of the second ends 48 of the leg members has a well 49 extending therein. Each of the wells 49 extends to a point generally adjacent to the shaft 40, 41. The leg members have a slot 50 therein extending through a peripheral wall of the legs and into the well 49. The slots 50 each have at least one notch 51 therein and ideally have the shape of a pair of J's coupled together such that a bottom section of an uppermost J defines the notch.

A first 52 of a pair of rods is integrally coupled to and extends between the first 43 and second 44 legs. The first 52 rod is positioned nearer the second ends 48 of the first and second legs than the shaft 40. A second 53 of the rods is integrally coupled to and extends between the third 45 and fourth 46 legs. The second rod 53 is positioned nearer the second ends 48 of the first and second legs than the shaft. Each of the rods 52, 53 has a length substantially equal to 3½ inches.

A plurality of extension members 54 selectively extends into the leg members. Each of the extension members 54 is elongate and has a first end movably extendable into one of the wells 49. Each of extension members 54 has a pin 55 thereon extending through a respective slot 50 for removably engaging the notch 51 in the slot. Each of the extension members 54 has a length less than 4 inches.

A plurality of biasing members 71 biases the extension members 54 outward of the wells 49. Each of the biasing members 71 is positioned in one of the wells 49 between the first ends 47 of the leg members and respective extension member 54. Each of the biasing members 71 preferably comprises a spring.

Each of a plurality of feet 56 is securely attached to one of a second end of the extension members 54. Each of the feet 56 comprises an elastomeric material to prevent slippage.

Each of a pair of elongate flexible members 57 has a first end 58 and a second end 59. Each of the first ends 58 is securely attached to a bottom surface 14 of the plate 12 and is positioned generally adjacent to one of the shafts 40, 41. Each of the second ends 59 of the elongate members is securely attached to a respectively adjacent rod 52, 53. Each of the elongate flexible members 57 has a length such that a greatest angle defined by the leg members and the bottom surface of the plate 12 is between 90 degrees and 100 degrees, however the lip 19 will generally prevent the legs from moving beyond 100 degrees. Each of the elongate members 57 is preferably a chain.

A pair of couplers 60 removably couples the rods 52, 53 to the bottom surface 14 of the plate. Each of the couplers 60 is securely attached to the bottom surface 14 of the first 27 and second 28 portions and positioned to engage one of the rods 52, 53 when the leg members are abutting the bottom surface 14 of the plate 12. Each of the couplers 60 comprises a tubular member having a pair of ends and has a break 61 therein extending along the couplers and through the ends. Each of the rods 52, 53 may be moved through one of the breaks in the couplers such that each of the rods is in one of the couplers.

Figure 7:
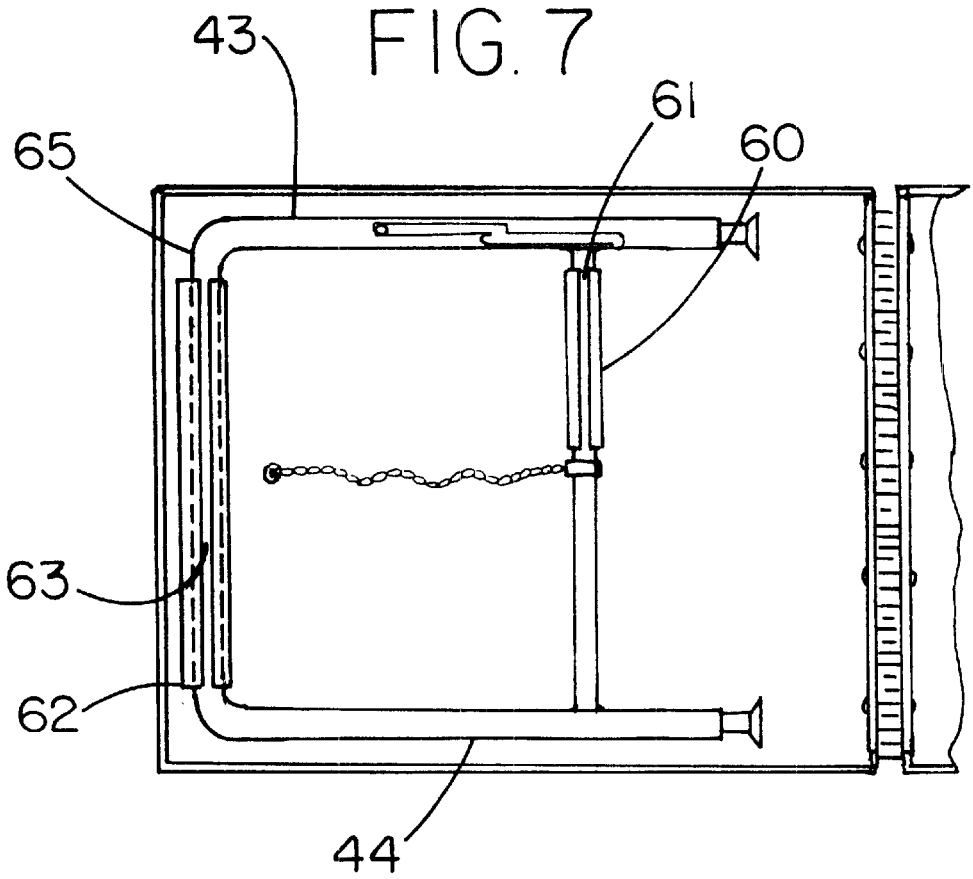
FIG. 7 is a schematic bottom view of the second embodiment of the present invention.
Figure 8:
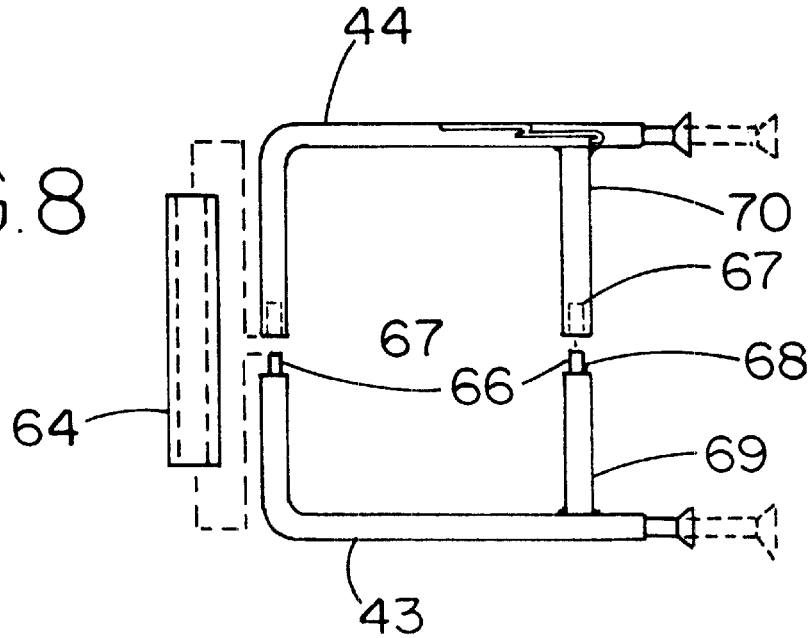
FIG. 8 is a schematic bottom view of the third embodiment of the present invention.
Figure 9:
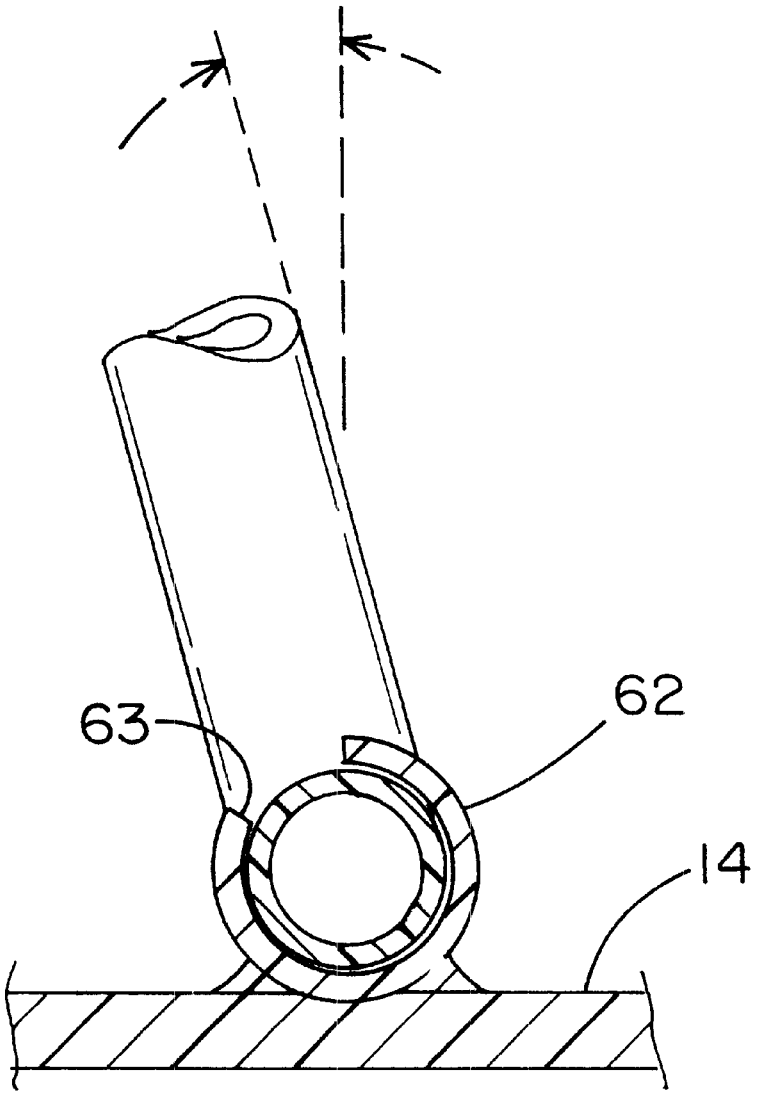
FIG. 9 is a schematic side cross-sectional view of the cylindrical member of the second embodiment.

The second and third embodiments are shown in FIGS. 7, 8 and 9. The differences are primarily in the legs bracket assembly. FIG. 7 depicts the second embodiment, FIG. 8 the third, and FIG. 9 shows a cylindrical member 62 used in the second embodiment.

The second and third embodiments each employ a pair of cylindrical members 62 securely coupled to the bottom surface 14 of the plate 12 and each positioned generally adjacent and parallel to one of the first 22 and second 23 side portions of the lip. Each of the cylindrical members 62 of the second embodiment has an elongated slot 63 therein extending from and through opposite ends of the cylindrical members. In the second embodiment, the first 43 and second 44 legs have first ends 47 coupled together by a middle portion 65, and the third 45 and fourth 46 legs have first ends 47 coupled together by a middle portion 65. Each of the middle portions is positionable in one of the cylindrical members 62.

The third embodiment employs a pair of joint members for removably securing the first leg to the second leg and the third leg to the fourth leg and a cylindrical member 64 not requiring a slot 63. Each of the joint members comprises a male portion 66 and a female portion 67. Each of the male portions 66 is securely attached to and extending away from the first ends of the first 43 and third 45 leg members. The male portions 66 are orientated generally perpendicular to an associated leg member. Each of the female portions 67 is securely attached to and extends away from the first ends of the second 44 and fourth 46 leg members. The female portions 67 are orientated generally perpendicular to an associated leg member. The male 66 and female 67 portions are each extended through opposite open ends of the cylindrical member 64 and coupled together such that the legs are rotatably coupled to the cylindrical members 64. The first rod 52 is integrally coupled to and extends between the first and second legs. The second rod 53 is integrally coupled to and extends between the third and fourth legs. Each of the rods 52, 53 has break 68 therein such that a first section 69 and a second section 70 are defined. Each of the first sections 69 has a male coupler 66 thereon and each of said second sections 70 has a female coupler 67 thereon for removably coupling the first sections 69 with the second sections 70.

In use, the device is used as a foot rest where needed due to chair being too high or for general comfort. The grooves 24, 25 allow for finger grips to pull the magnets 32 away from the metal portions 31. The plate 12 is then opened to its planar position and the legs pulled outward away from the plate. The extension members 54 may be used to extend the length of the legs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot rest device comprising:

a table portion including a plate having a top surface, a bottom surface, a front edge, a back edge, a first side edge and a second side edge;

a support assembly for supporting said table portion above a ground surface, said support assembly comprising a bracket assembly securely coupled to said bottom surface of said plate, and a plurality of leg members, each of said legs members having a first end rotatably coupled to said bracket assembly, wherein said leg members may be selectively rotated between a position abutting said plate and a position extending away from said plate;

a peripheral lip being integrally coupled to and extending downward from said plate such that a front portion, a back portion, a first side portion and second side portion of said peripheral lip is defined with respect to said front, back and side edges of said plate;

wherein said plate has a break therein extending between said front and back edges and through said lip such that a first and second portion of said table portion is defined, and wherein each of said legs has a length less than a length of a distance of said break to said first and second side edges;

a hinge for hingedly coupling said first portion to said second portion, said hinge being securely coupled to a flange extending downwardly from either side of said break such that said first and second portions may selectively be positioned between an open position and a closed position; and said bracket assembly including a pair of cylindrical members each being securely coupled to said bottom surface of said plate and each positioned generally adjacent and parallel to one of said first and second side portions of said lip, each of said cylindrical members having an elongated slot therein extending from and through opposite ends of said cylindrical members, and a first and a second leg having first ends coupled together by a middle portion extending between said first ends, a third and a fourth leg having first ends coupled together by a middle portion extending between said first ends, each of said middle portions being positionable through one of said slots of said cylindrical members such that each of said middle portions is pivotal in an associated one of said cylindrical members to permit selective extension of said first and second legs and said third and fourth legs.

2. The foot rest device as in claim 1, wherein said plate has a length between said side edges generally between 8 inches and 12 inches and a width between said front and back edges generally between 4 and 6 inches.

3. The foot rest device as in claim 1, further comprising:

each of said second ends of said leg members having a well extending therein, each of said wells extending to a point generally adjacent to said shaft;

each of said leg members having a slot therein extending through a peripheral wall of said legs and into said well, each of said slots having at least one notch therein;

a plurality of extension members for selectively extending a length of said leg members, each of said extension members being elongate and having a first end movably extendable into one of said wells, each of extension members having a pin thereon extending through a respective slot for removably engaging the notch in said slot;

a plurality of biasing members for biasing said extension members outward of said wells, each of said biasing members being positioned in one of said wells between the first ends of the leg members and respective extension member, and a plurality of feet, each of said feet being securely attached to one of a second end of said extension members.

4. The foot rest device as in claim 3, further comprising:

a pair of rods, a first of said rods being integrally coupled to and extending between said first and second legs, a second of said rods being integrally coupled to and extending between said third and fourth legs.

5. The foot rest device as in claim 4, further comprising:

a pair of elongate flexible members each having a first end and a second end, each of said first ends being securely attached to a bottom surface of said plate and positioned generally adjacent to one of said cylindrical members, each of said second ends of said elongate members being securely attached to a respectively adjacent rod, each of said elongate flexible members having a length such that a greatest angle defined by said leg members and said bottom surface of said plate is between 90 degrees and 100 degrees.

* * * * *